US010687566B2

(12) United States Patent
Brandt

(10) Patent No.: US 10,687,566 B2
(45) Date of Patent: Jun. 23, 2020

(54) MODULAR IMPACT PROTECTION SYSTEM FOR ATHLETIC WEAR

(71) Applicant: NIKE, Inc., Beaverton, OR (US)

(72) Inventor: Baron C. Brandt, Portland, OR (US)

(73) Assignee: NIKE, INC., Beaverton, OR (US)

( * ) Notice: Subject to any disclaimer, the term of this patent is extended or adjusted under 35 U.S.C. 154(b) by 72 days.

(21) Appl. No.: 16/008,881

(22) Filed: Jun. 14, 2018

(65) Prior Publication Data

US 2018/0289083 A1 Oct. 11, 2018

Related U.S. Application Data

(62) Division of application No. 14/321,290, filed on Jul. 1, 2014, now Pat. No. 10,021,922.

(60) Provisional application No. 61/841,804, filed on Jul. 1, 2013.

(51) Int. Cl.
*A41D 13/015* (2006.01)

(52) U.S. Cl.
CPC ..... *A41D 13/015* (2013.01); *A41D 13/0153* (2013.01); *A41D 13/0156* (2013.01)

(58) Field of Classification Search
CPC .. A41D 13/00; A41D 13/015; A41D 13/0151; A41D 13/0156; A41D 13/0153; A41D 31/0044; A41D 2600/10; B32B 5/24; B32B 5/245
USPC ..... 2/455, 24, 465, 267, 22, 227, 228, 466, 2/69, 79, 911; 442/1, 370, 372, 373
See application file for complete search history.

(56) References Cited

U.S. PATENT DOCUMENTS

| | | | | |
|---|---|---|---|---|
| 4,807,301 | A | 2/1989 | Ferber | |
| 5,497,511 | A | 3/1996 | Zade | |
| 5,518,802 | A * | 5/1996 | Colvin | B32B 3/12 428/166 |
| 6,519,781 | B1 * | 2/2003 | Berns | A41D 13/0153 2/267 |
| 6,532,599 | B1 | 3/2003 | Dugan | |
| D472,678 | S * | 4/2003 | Cho | A41D 13/0153 D29/120.1 |
| 6,654,960 | B2 * | 12/2003 | Cho | A63B 71/1225 2/22 |
| D582,608 | S * | 12/2008 | Palmer | D29/121.1 |
| 8,220,072 | B2 * | 7/2012 | Dodd | A41D 13/0153 2/22 |

(Continued)

FOREIGN PATENT DOCUMENTS

| | | | |
|---|---|---|---|
| DE | 10219521 | A1 | 11/2003 |
| FR | 2974480 | A1 | 11/2012 |

(Continued)

OTHER PUBLICATIONS

Communication pursuant to Article 94(3) dated Mar. 27, 2019 in European Patent Application No. 14820305.2, 7 pages.

*Primary Examiner* — Sally Haden
(74) *Attorney, Agent, or Firm* — Shook, Hardy & Bacon, LLP

(57) ABSTRACT

A modular protective structure may be formed from an impact absorbing material formed into a repeating pattern of one or more geometrical shapes that may be assembled to a size, shape, and/or configuration desired to protect an athlete from impact. The thickness of the structure may vary in a repetitive fashion along at least a first axis of the structure, and may further vary in a repetitive fashion along a second axis of the structure.

5 Claims, 7 Drawing Sheets

(56) References Cited

U.S. PATENT DOCUMENTS

| | | | | |
|---|---|---|---|---|
| 8,661,564 | B2 * | 3/2014 | Dodd | A41D 13/0153 2/22 |
| 2004/0009723 | A1 * | 1/2004 | Tsai | B32B 7/12 442/1 |
| 2008/0282438 | A1 | 11/2008 | Boutaghou | |
| 2009/0165193 | A1 * | 7/2009 | Michel | A41D 13/0153 2/459 |
| 2011/0099696 | A1 * | 5/2011 | Smith | A41D 13/0506 2/455 |
| 2011/0113559 | A1 * | 5/2011 | Dodd | A41D 13/0153 5/690 |
| 2011/0247240 | A1 * | 10/2011 | Eder | A43B 1/0009 36/133 |
| 2012/0255105 | A1 * | 10/2012 | Turner | A41D 13/0506 2/455 |
| 2013/0234376 | A1 * | 9/2013 | Frey | A42B 3/065 267/141 |

FOREIGN PATENT DOCUMENTS

| | | | |
|---|---|---|---|
| JP | 2007224449 | A | 9/2007 |
| WO | 2013026077 | A1 | 2/2013 |

* cited by examiner

MODULAR IMPACT PROTECTION SYSTEM FOR ATHLETIC WEAR

CROSS-REFERENCE TO RELATED APPLICATIONS

This application, entitled "Modular Impact Protection System for Athletic Wear," is a divisional of, and claims priority to co-pending U.S. Nonprovisional application Ser. No. 14/321,290, filed Jul. 1, 2014, and entitled "Modular Impact Protection System for Athletic Wear," which claims priority to U.S. Provisional Application No. 61/841,804, filed Jul. 1, 2013 and entitled "Modular Impact Protection System for Athletic Wear." The entireties of the aforementioned applications are incorporated by reference herein.

FIELD

The present invention relates to player protection and impact absorption. More particularly, the present invention relates to wearable padding systems that may be assembled in configurations, sizes, and shapes to be well adapted to the comfort and protection of an athlete during practice or competition.

SUMMARY

Impact protection systems in accordance with the present invention may be assembled from a plurality of components. Components may be formed of impact absorbing materials, such as rubbers, nylons, silicone, or any type of material capable of being formed via injection molding, additive manufacturing processes, or other forming processes. Other materials that may be used, either alone or in combination with other types of materials, are polymers (such as polypropylene, polyethylene, polyester, polycarbonate, polyamide, and the like), carbon fibers (potentially with binders), any type of elastomer, or any material able to absorb impact to protect the athlete wearing the modular padding. By providing modular components having repetitive geometric shapes, a padding system may be assembled from a plurality of impact protection components.

In examples, a component such as may be used in systems in accordance with the present invention may have a thickness in an as-worn position that varies in a repetitive manner along the component. The variance and thickness may provide different amounts of impact protection but may also provide enhanced impact protection by providing portions that are engaged at different time points during an impact. For example, at its thickest location, a protective component may be contacted first by a player, ball, piece of sporting equipment, etc. impacting the player wearing the protective system in accordance with the present invention. As the material forming the protective component absorbs the impact, additional portions of the component having varying thicknesses may be engaged, thereby absorbing additional force from the impact to lessen the undesirable effect on the player wearing the protective system. Further, the use of different portions of a component with different thicknesses, or even no thickness at all (a hole or orifice), the pliability and breathability of the protective system may be enhanced while still maintaining a high degree of impact protection for a wearer.

The variation in thickness of modular components assembled in a system in accordance with the present invention may vary along one or more axis in an as-worn position. The variation of thickness may vary in a first pattern along a first axis and may vary in a second pattern along a second axis. In addition to providing varying impact protection responsive to different forces of impact, the repetitive patterns of variable thickness may be part of an interlocking geometry that permits potentially varying sizes of impact protection systems to be assembled from only a small number of discrete types of components.

Components providing impact protection in accordance with the present invention may take a variety of geometrical shapes. Any given system may employ identical geometrical shapes of components or a mixture of different geometrical shapes of components. Example component geometries are triangles, hexagons, strips, quadrilaterals, rectangles, etc. A given protective component geometry in accordance with the present invention may comprise one or more subcomponents. For example, a quadrilateral component in accordance with the present invention may be formed from a plurality of triangular components extending along the quadrilateral. Such a quadrilateral may be provided in the form of strips, tapes, or other structures that may be severed, separated, assembled, or otherwise constructed to a desired length, width, and shape to conform to the portion of anatomy to be protected using the components in accordance with the present invention.

Systems in accordance with the present invention may be used for American football, soccer, basketball, or any other athletic endeavor where a participant desires additional protection from impact. Protection from impact afforded by systems in accordance with the present invention may be particularly suited for the protection of temporary injuries of an athlete, such as bruises or contusions, while those injuries heal, thereby permitting an athlete to participate in training or competition during at least a part of the recovery process.

Components of a protective system in accordance with the present invention may be retained in an as-worn position over a portion of an athlete's anatomy to be protected in a variety of fashions. For example, the athlete may wear a garment providing a pocket or pockets to receive components of an impact protection system in accordance with the present invention. In such an example, an athlete or trainer may optionally provide a desired amount and configuration of components within the pockets corresponding to portions of an athlete's anatomy where additional protection is desired, although components in accordance with the present invention may be provided permanently affixed to such a garment. By way of further example, components in accordance with the present invention may be provided affixed to elastic materials that may encircle at least a portion of an athlete's anatomy to temporarily retain a desired configuration of components over a portion of the athlete's anatomy. By way of yet further example, an adhesive may be provided on the components of a system in accordance with the present invention that may be used to temporarily engage with the skin and/or garments worn by the athlete to temporarily affix the components of a system in accordance with the present invention into an as-worn position to protect a portion of the athlete's anatomy.

The precise sizes, materials, geometries, mechanisms used to retain components in an as-worn position, and the like, may vary without departing from the scope of the present invention, and are described herein in examples for exemplary purposes only.

DETAILED DESCRIPTION

Figure 1A:
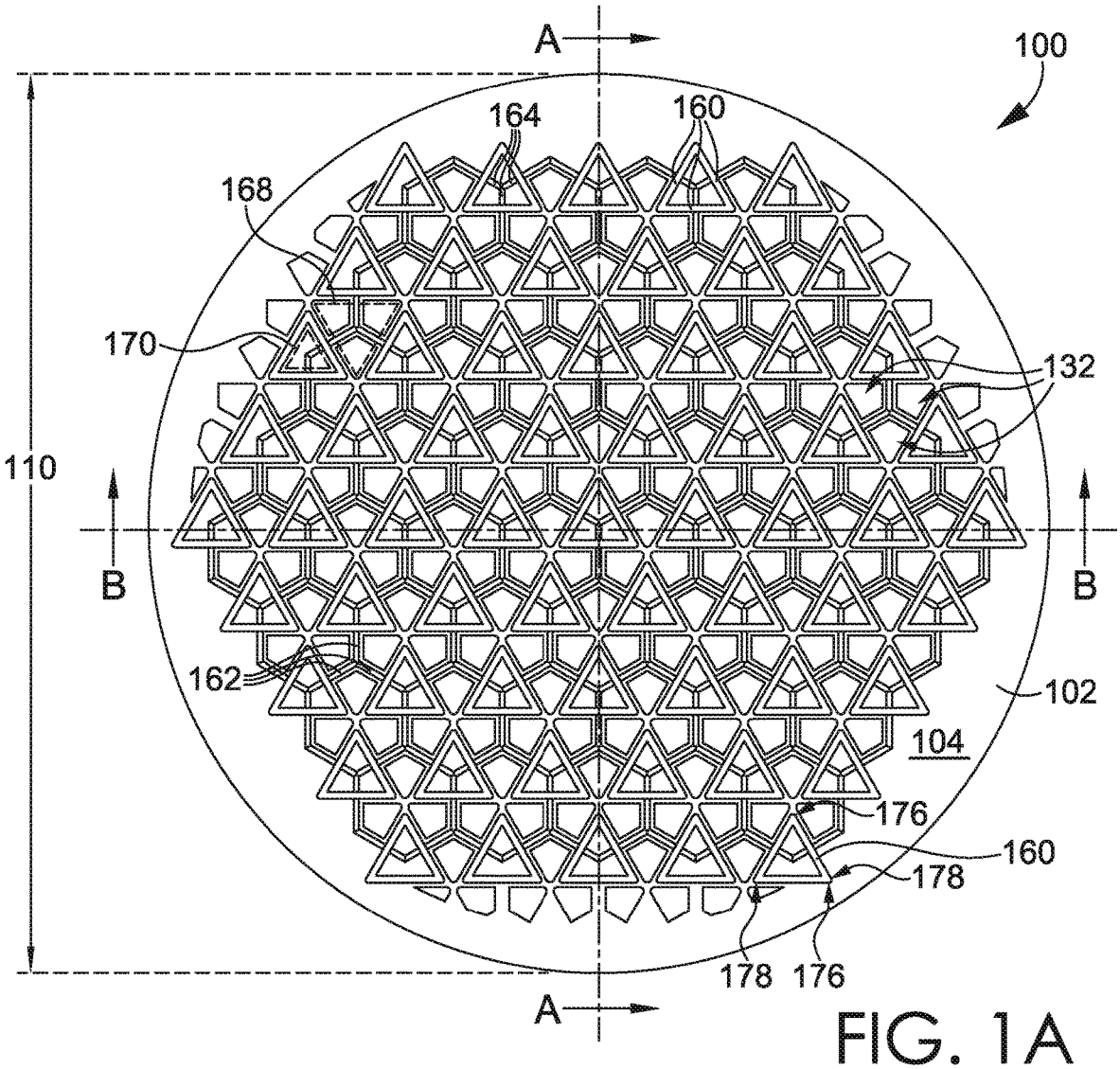
FIGS. 1A-1E illustrate an example of a modular impact protection system in accordance with the present invention.

Referring now to FIG. 1A, a hexagonal component 100 that may comprise a component for use in providing impact protection in accordance with the present invention is illustrated. Hexagonal component 100 incorporates a plurality of geometrical shapes within hexagonal component 100, as can be seen in FIG. 1A and as will be discussed further below. FIG. 1A illustrates a cross-sectional line A taken along a first axis and a second cross-sectional line B taken along a second axis. In the example illustrated in FIG. 1A, the first axis of line A and the second axis of line B are perpendicular. When in an as-worn position, both line A and line B may be expected to extend substantially along the anatomy of the wearer. As illustrated in FIG. 1A, the hexagonal component 100 may have a total height 110. While different implementations of systems in accordance with the present invention may utilize different sizes of components, length 110 may comprise, for example, 115 mm or, more generally, between 100 mm and 200 mm. In some aspects the component 100 includes a base panel 102 having a first surface 104 opposite a second surface 106 (as best seen in FIG. 1B).

Figure 1B:
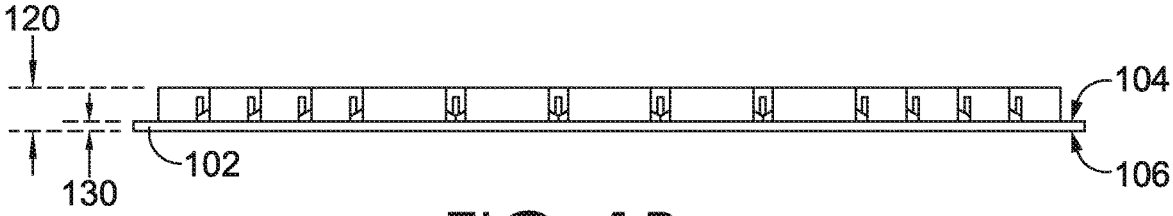

Referring now to FIG. 1B, a general representation of the varying thickness of hexagonal component 100 is illustrated. As shown in FIG. 1B, the maximum thickness of hexagonal component 100 may comprise thickness 120, while the minimum thickness may comprise thickness 130. In examples, maximum thickness 120 may comprise several millimeters, up to about 10 mm and, for example, may comprise 4.5 mm. Minimum thickness 130 may comprise a basic minimal thickness of the materials used to form hexagonal component 100. For example, minimum thickness 130 may be the distance the base panel 102 extends between the first surface 104 and the second surface 106. Minimum thickness 130 may comprise, for example, less than 1 mm, such as 0.5 mm. Notably, holes or openings may be provided entirely through a component such as hexagonal component 100, such that minimum thickness 130 need not be present at all locations of a component in accordance with the present invention. For example, an at least one aperture 132 may extend through the component 100 (as best seen in FIGS. 1A and 1E). In some aspects, the at least one aperture 132 may be divided into three apertures (as best seen in FIGS. 1A and 1E).

Figure 1C:
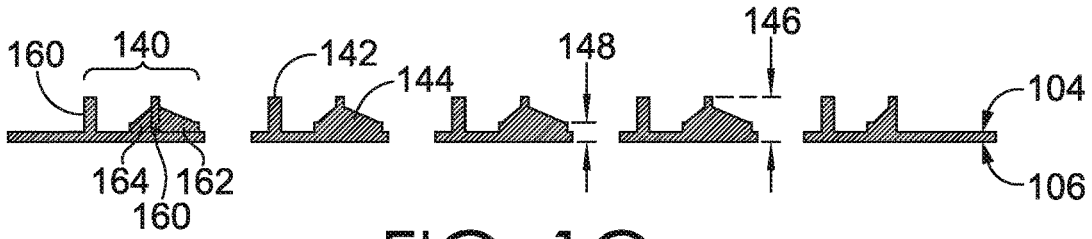

Referring now to FIG. 1C, a repetitive thickness of component 100 taken along line A is illustrated. As shown in FIG. 1C, units 140 of varying thickness may be repeated to form a pattern. In some aspects, the pattern may include a plurality of first wall portions 160, a plurality of second wall portions 162, and a plurality of third wall portions 164. In the present example, unit 140 provides a first structure 142 having a thickness 146, which may correspond to maximum thickness 120, but need not, and a second component 144. The first structure 142 may comprise one of the plurality of first wall portions 160. In the example shown in FIG. 1C, second component 144 has a varying height that commences at first height 146 and changes along line A to a second thickness 148. Second thickness 148 may be, but need not be, the same as minimum thickness 130. The second component 144 may comprise one wall of the plurality of first wall portions 160, one wall of the plurality of second wall portions 162, and one wall of the third wall portions 164.

In some aspects, each of the plurality of first wall portions 160 may be coupled to the first surface 104 and extend distally away from the first surface 104. Each wall of the plurality of first wall portions 160 may include a first distal edge 166 and a first wall height measured between the second surface 106 and the first distal edge 166. The first wall height may be the maximum thickness 120 and may be constant across the base panel 102. The plurality of first wall portions 160 may form a plurality of repeating shapes positioned across the base panel 102 in the pattern and may be spaced apart by an interstitial space 168. In some aspects, each repeating shape of the plurality of repeating shapes may include a set of first wall portions 180 that form a perimeter around a wall-bound space 170. In further aspects, each of the plurality of first wall portions 160 may include a first end 176 and a second end 178 between which said first wall portion extends. The first end 176 of each first wall portion may be joined to an adjacent second end 178 of an adjacent first wall portion (as best seen in FIG. 1A).

Similarly, each of the plurality of second wall portions 162 may be coupled to the first surface 104 and extend distally away from the first surface 104. Each wall of the plurality of second wall portions 162 may include a second distal edge 172 and a second wall height measured between the second surface 106 and the second distal edge 172. The second wall height of each of the plurality of second wall portions 162 may be less than the first wall height of the plurality of first wall portions 160. Each of the plurality of second wall portions 162 may intersect with at least one other second wall portion 162 in the interstitial space 168. Each of the plurality of second wall portions 162 may intersect with at least one of the plurality of first wall portions 160. The second wall height of each of the plurality of second wall portions 162 may vary across the base panel 102.

Each of the plurality of third wall portions 164 may be coupled to the first surface 104 and may extend distally away from the first surface 104. Each of the plurality of third wall portions 164 may include a third distal edge 174 and a third wall height measured between the second surface 106 and the third distal edge 174. The third wall height of each of the plurality of third wall portions 164 may be less than the first wall height of the plurality of first wall portions 160. Each of the plurality of third wall portions 164 may intersect with at least one other third wall portion 164 in the wall-bound space 170. Each of the plurality of third wall portions 164 may intersect with at least one of the plurality of first wall portions 160. The third wall height of each of the plurality of third wall portions 164 may vary across the base panel 102.

Figure 1D:
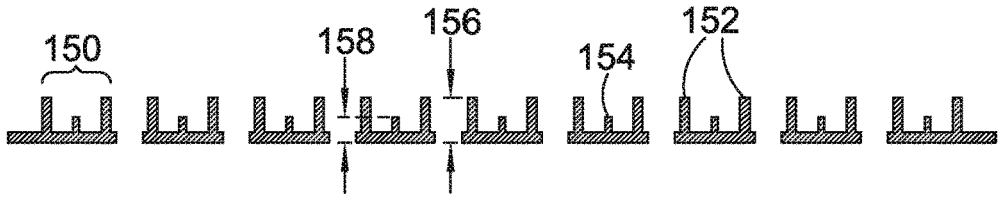
Figure 1E:
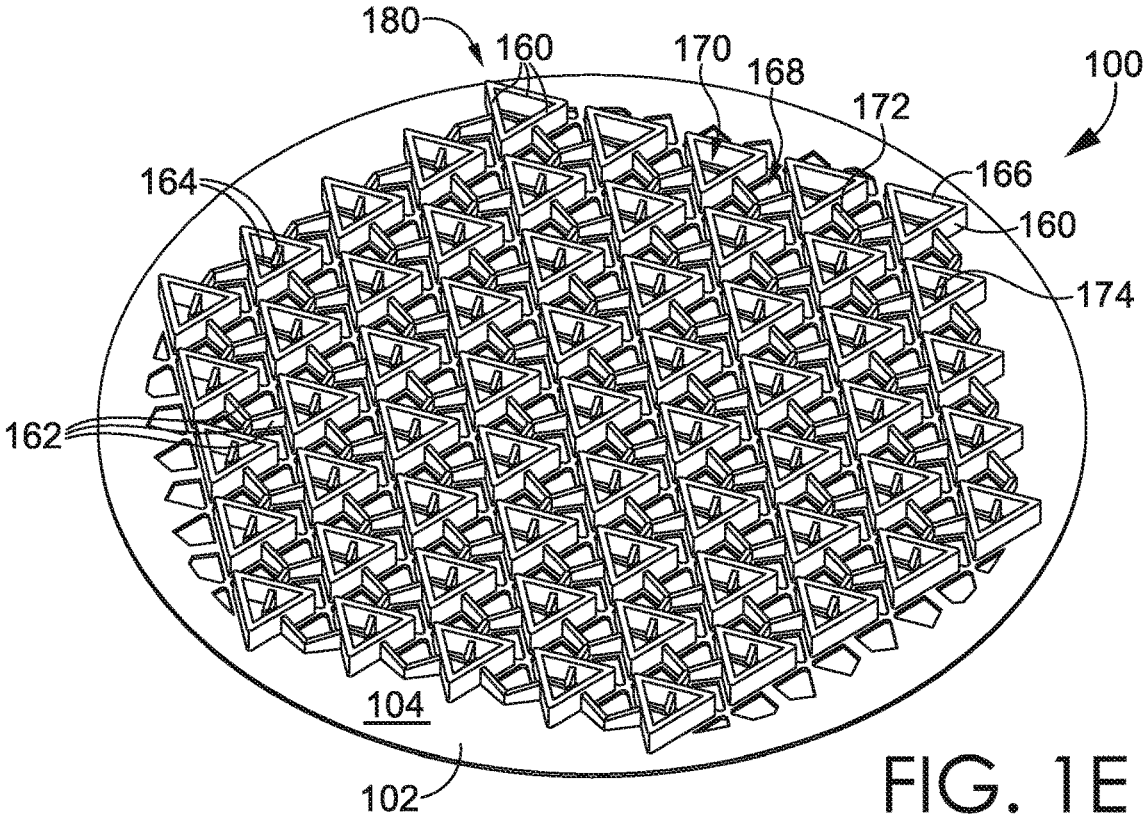

Referring now to FIG. 1D, a repetitive pattern of thickness taken along line B is illustrated. In the example shown in FIG. 1D, a unit 150 repeats over the component 100 along line B. In the example shown in FIG. 1D, each unit 150 comprises a pair of protrusions 152 having a first thickness 156. First thickness 156 may correspond to maximum thickness 120, but need not. As further shown in the example of FIG. 1D, unit 150 also possesses a second component 154 between first components 152. Second component 154 has a second thickness 158 that is less than the first thickness 156. Second thickness 158 may be at least the minimum thickness 130, but may be greater than minimum thickness 130.

The examples shown in FIG. 1C and FIG. 1D are exemplary only. A variety of repeating thickness patterns may be used along axes of a component in accordance with the present invention, such as component 100. In the present example, a different varying thickness pattern is provided along different axes, but the same repetitive thickness pattern may be provided for both axes. FIG. 1E depicts the hexagonal component 100 in an as-used configuration.

Figure 2:
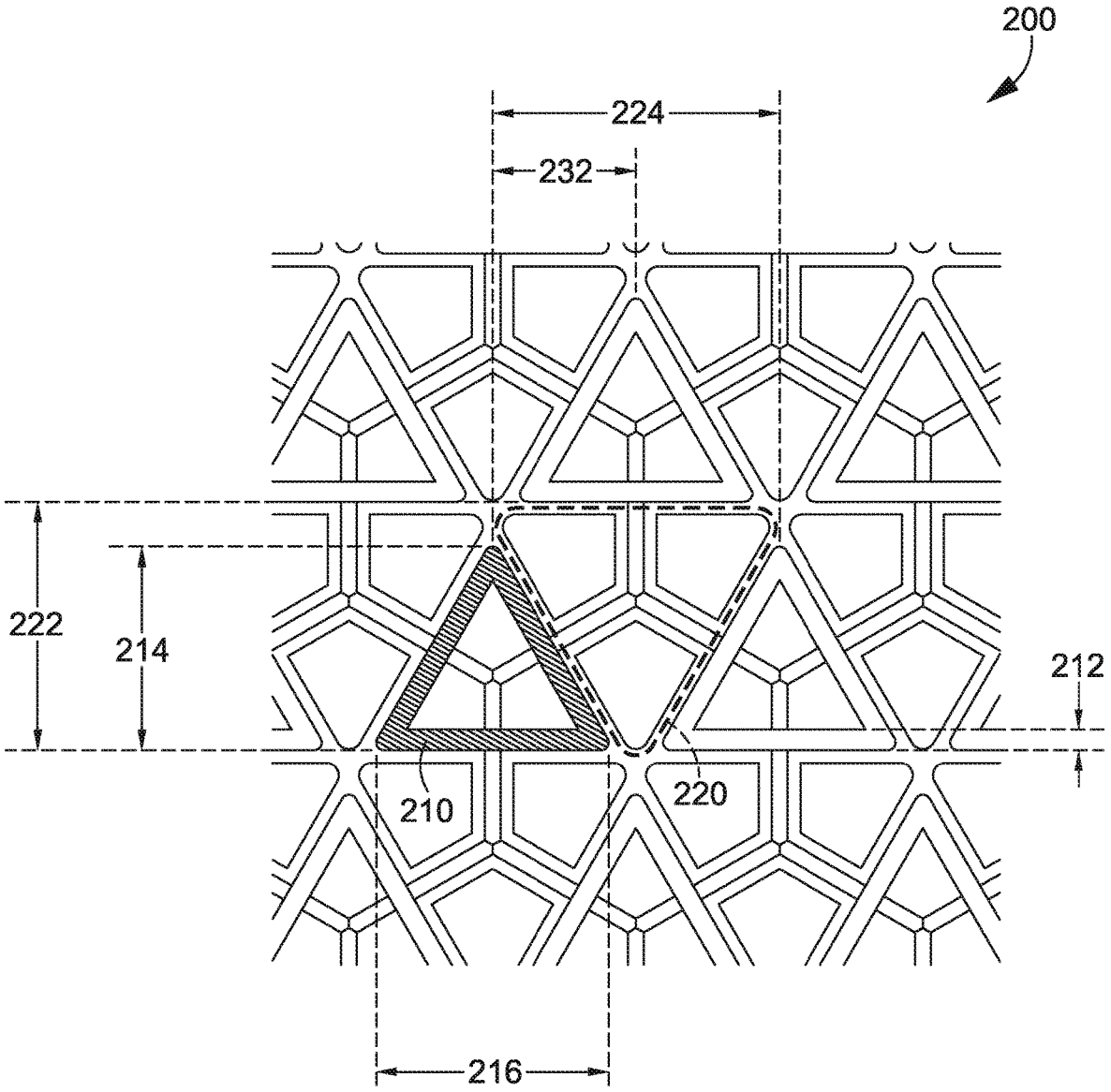
FIG. 2 illustrates an example of geometrical structures that may be used in accordance with the present invention.

Referring now to FIG. 2, a variety of geometries within a portion 200 of a component is illustrated. Portion 200 may comprise part of a component such as component 100 described above, but it may be utilized for other overall shapes and configurations of components in accordance with the present invention. Portion 200 is presented for exemplary purposes only, and other geometries than those depicted in portion 200 illustrated in FIG. 2 may be utilized. The geometry of a portion 200 may comprise, at least in part, a plurality of triangles such as triangle 210 illustrated in crosshatching. As can be seen in FIG. 2, triangle 210 is only one example of numerous triangles having similar size and shape provided in the geometry of portion 200. Triangle 210 comprises an equilateral triangle formed from segment components having individual thicknesses 212. While thickness 212 may vary based upon the overall size of a component, the type of material used to form a component, the types of impacts anticipated, etc., thickness 212 may be between 0.5 mm and 1.5 mm and may more particularly be 0.9 mm or 1.0 mm. The triangle 210 formed by three segments having thickness 212 may have a width 216 and a height 214. While height 214 will necessarily vary in a known geometrical relationship based upon width 216, in examples width 216 may be in the range of 5 mm to 15 mm, such as 9.9 mm. If width 216 comprises 9.9 mm, height 214 may comprise approximately 8.6 mm.

Still referring to FIG. 2, a plurality of larger triangles is also provided in the geometry of portion 200. One larger triangle 220 is illustrated with a dashed line in FIG. 2, but numerous other congruent triangles are also provided in the present example. Triangle 220 may have an equilateral configuration formed from sides having a width 224 which may comprise, for example, between 10 and 20 mm. In the present example, width 224 may comprise 12.5 mm. Based upon the width 224 of sides of equilateral triangle 220, triangle 220 will have a height 222 that will vary with a known geometrical relationship. In the present example, if width 224 is approximately 12.5 mm, height 222 may comprise, for example, 10.8 mm. The apexes of triangles, such as triangles 210, may be separated by a linear distance 232. In the example dimensions described herein, distance 232 may comprise 6.2 mm, but this dimension will necessarily vary as the dimensions of triangles or other geometrical shapes utilized for a component such as the component illustrated in FIG. 2 are used.

Figure 3:
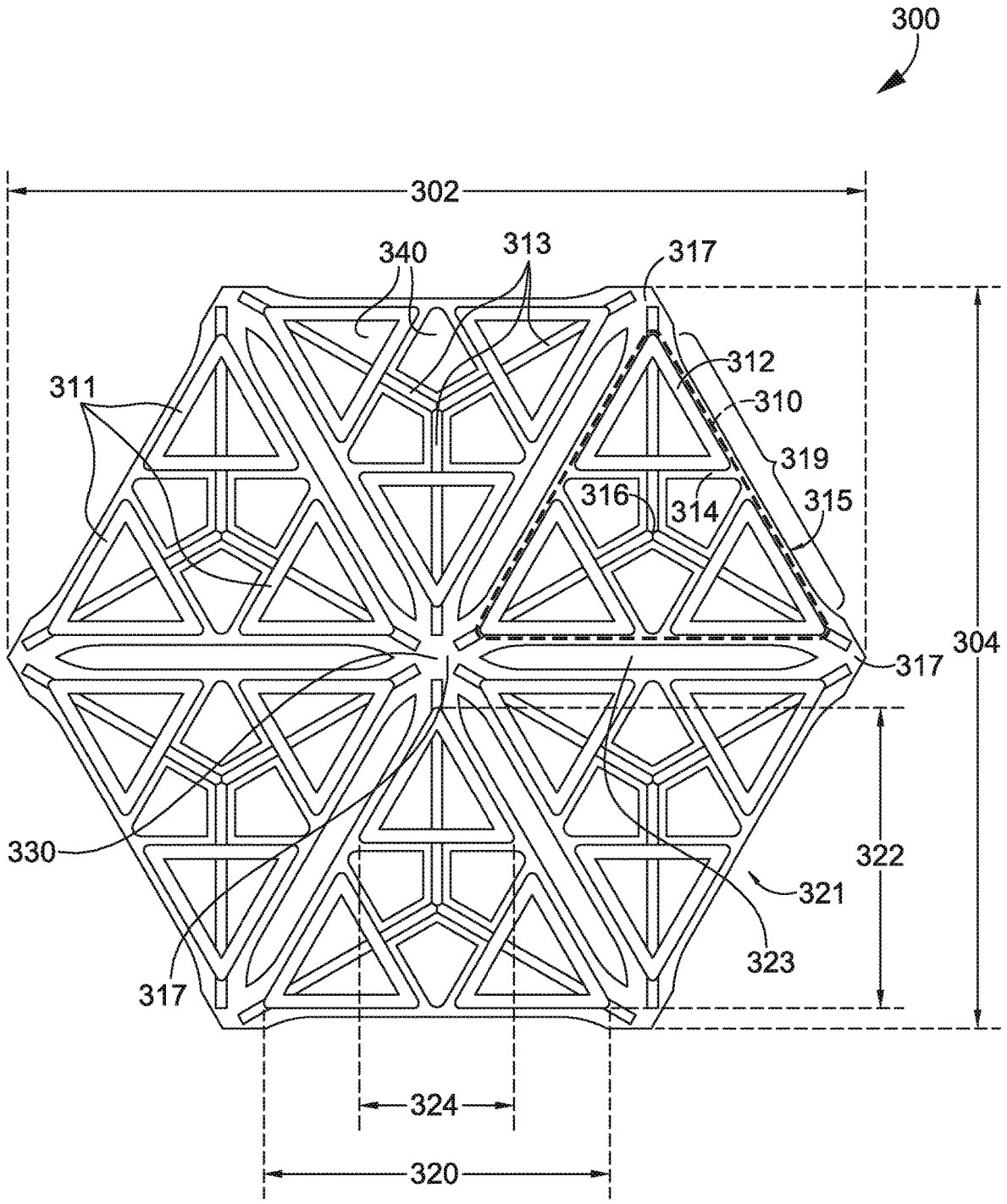
FIG. 3 illustrates a hexagonal component having triangular subcomponents in accordance with the present invention.

Referring now to FIG. 3, an example component 300 comprising a hexagon formed from a plurality of triangular components is illustrated. Hexagonal component 300 may comprise six triangular components, such as exemplary triangle component 310. As shown in the example of FIG. 3, a triangular component 310 may comprise a plurality of subcomponents. In the example of FIG. 3, triangular component 310 comprises triangular subcomponents such as small triangle 312 (which may comprise a first wall 311). As seen in the example of FIG. 3, triangular component 310 is formed from a total of four smaller triangular components, three of which correspond to the apexes of triangular component 310 and a fourth triangular subcomponent 314 occupying the interior of triangular component 310. In the example illustrated in FIG. 3, triangular component 310 may be structurally supported and reinforced by a lattice structure 316 comprising three spokes (which may comprise second walls 313) extending radially from the interior center of triangular component 310. The four smaller triangular components (e.g., the first walls 311 and fourth triangular subcomponent 314) and the lattice structure 316 (e.g., the second walls 313) may be surrounded by a perimeter edge 315. The triangular component 310 may include three or more side edges that comprise the perimeter edge 315. The triangular component 310 may include a nodal end 317 at each apex. The perimeter edge 315 of the triangular component 310 may include a recessed portion 319 between nodal ends at each apex. Adjacent recessed portions 319 between the triangular component 310 and an adjacent second triangular component 321 may define a slot 323 between the two triangular components. In the example of FIG. 3, each of the six triangular subcomponents, such as triangular component 310, has spokes that meet at the center 330 (e.g., a common nodal end) of overall hexagonal component 300. In further reference to FIG. 3, a plurality of gaps 340 are provided in the overall structure of hexagonal component 300 and its subcomponents such as triangular component 310. Gaps 340 may comprise a portion having a minimal thickness, or may simply comprise openings entirely through component 300 to permit enhanced flexibility and ventilation for the athlete wearing the protective component 300.

Still referring to FIG. 3, hexagonal component 300 may have an overall length and/or width 302. Width 302 may be the same as or different from height 304. An individual triangular component such as component 310 may have a width 320 and a height 322. A triangular subcomponent, such as subcomponent 312, may have a width 324 and a corresponding height. The configuration and size of components may be created in varying degrees by either assembling multiple components such as hexagonal component 300 or by separating hexagonal component 300 into discrete subcomponents by cutting material away to separate individual subcomponents, such as triangular component 310, subcomponent 312, etc.

Figure 4:
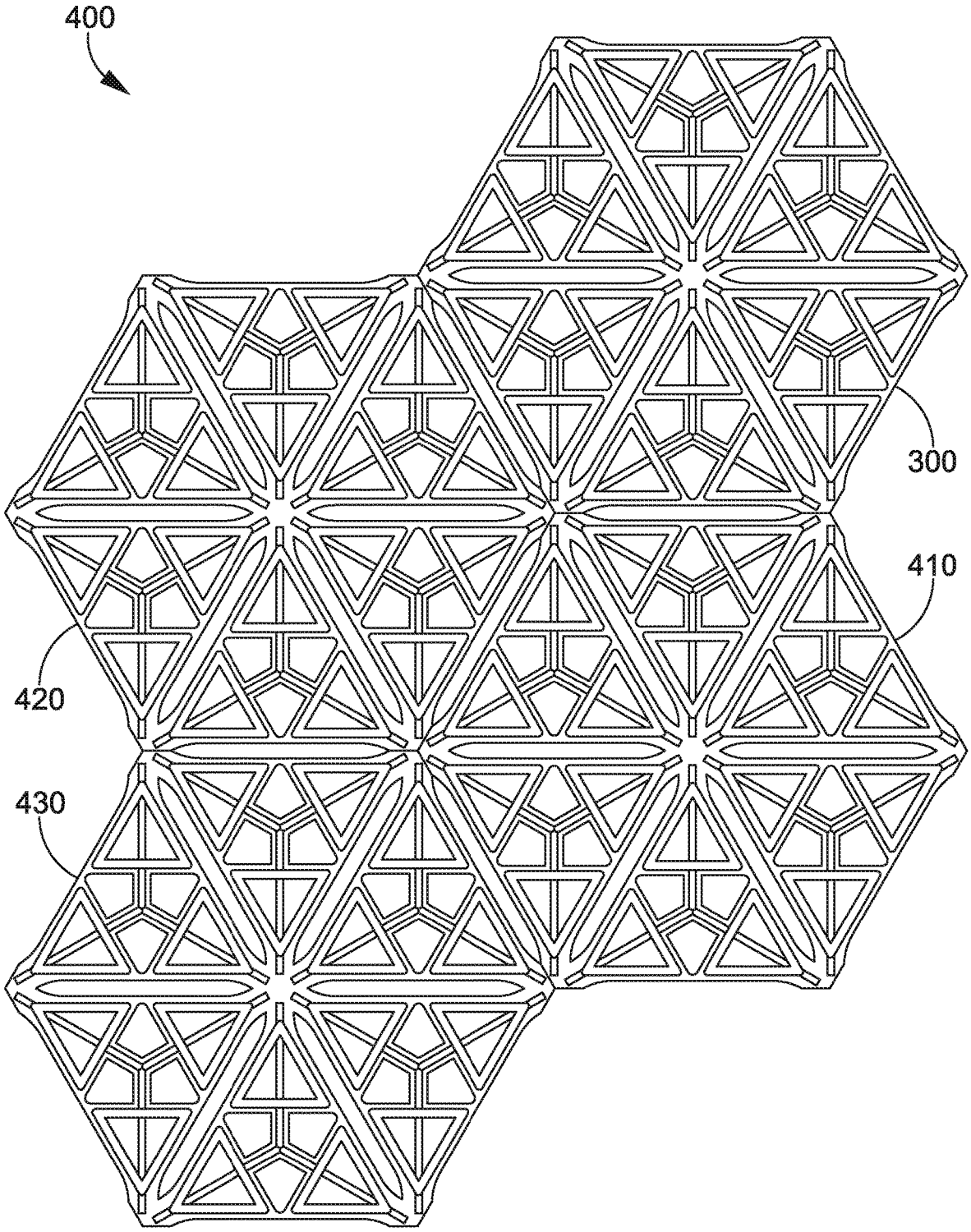
FIG. 4 illustrates a plurality of hexagonal components assembled in accordance with the present invention.

Referring now to FIG. 4, a plurality of hexagonal components such as component 300 are shown assembled into a single protective structure 400. In the present example of FIG. 4, component 300 has been combined with a second component 410, a third component 420, and a fourth component 430 to form larger component 400 to provide impact protection to an athlete. Other configurations of a component or an assembled protective structure 400 may be utilized in accordance with the present invention.

Figure 5:
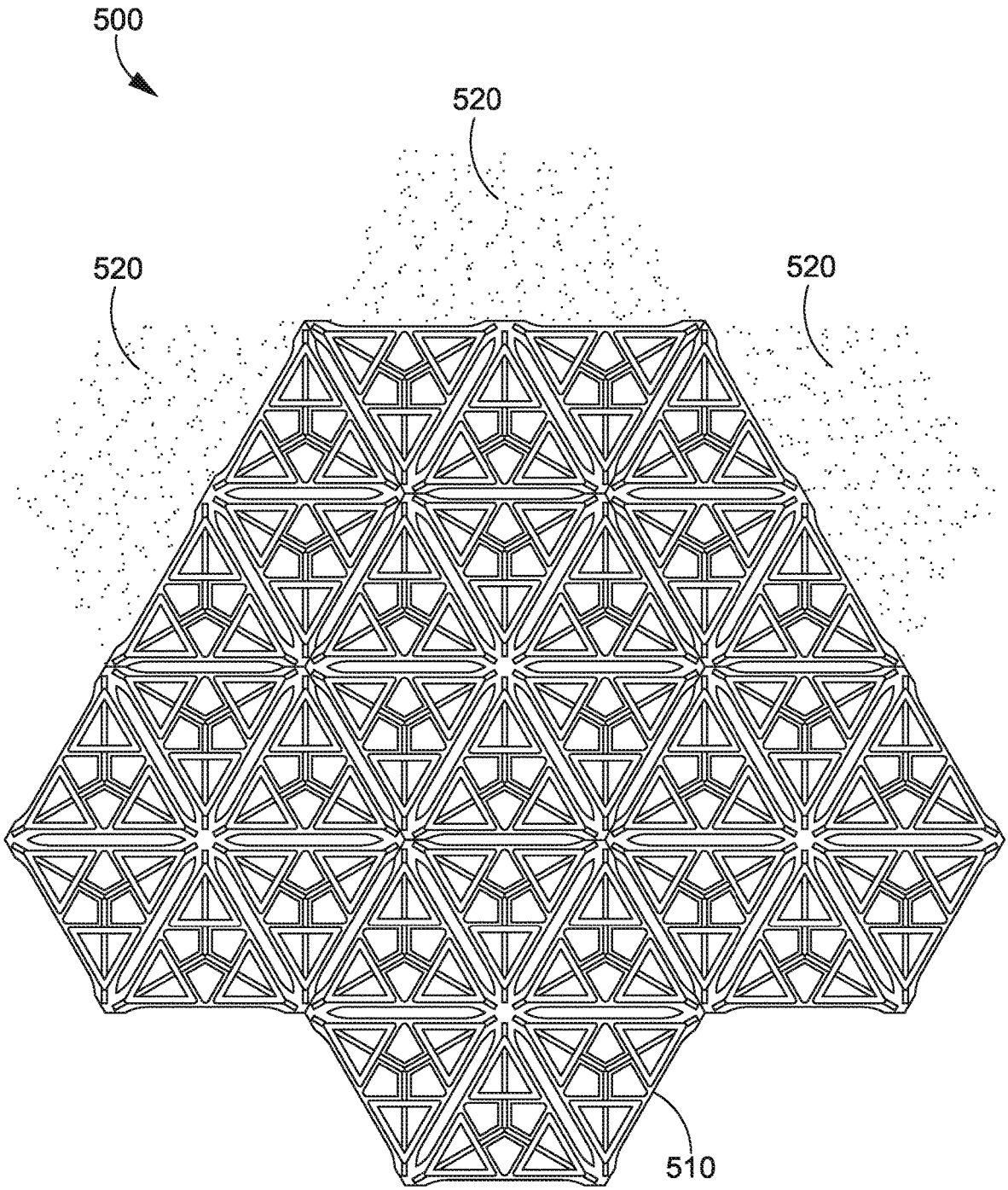
FIG. 5 illustrates a further example of components assembled in accordance with the present invention.

Referring now to FIG. 5, a protective structure 500 is illustrated. Protective structure 500 has been formed from a plurality of components such as hexagonal component 510. As shown in shadow, however, removed portions 520 have been cut from hexagonal component portions to provide a desired final shape, size, and configuration of protective structure 500.

Figure 6:
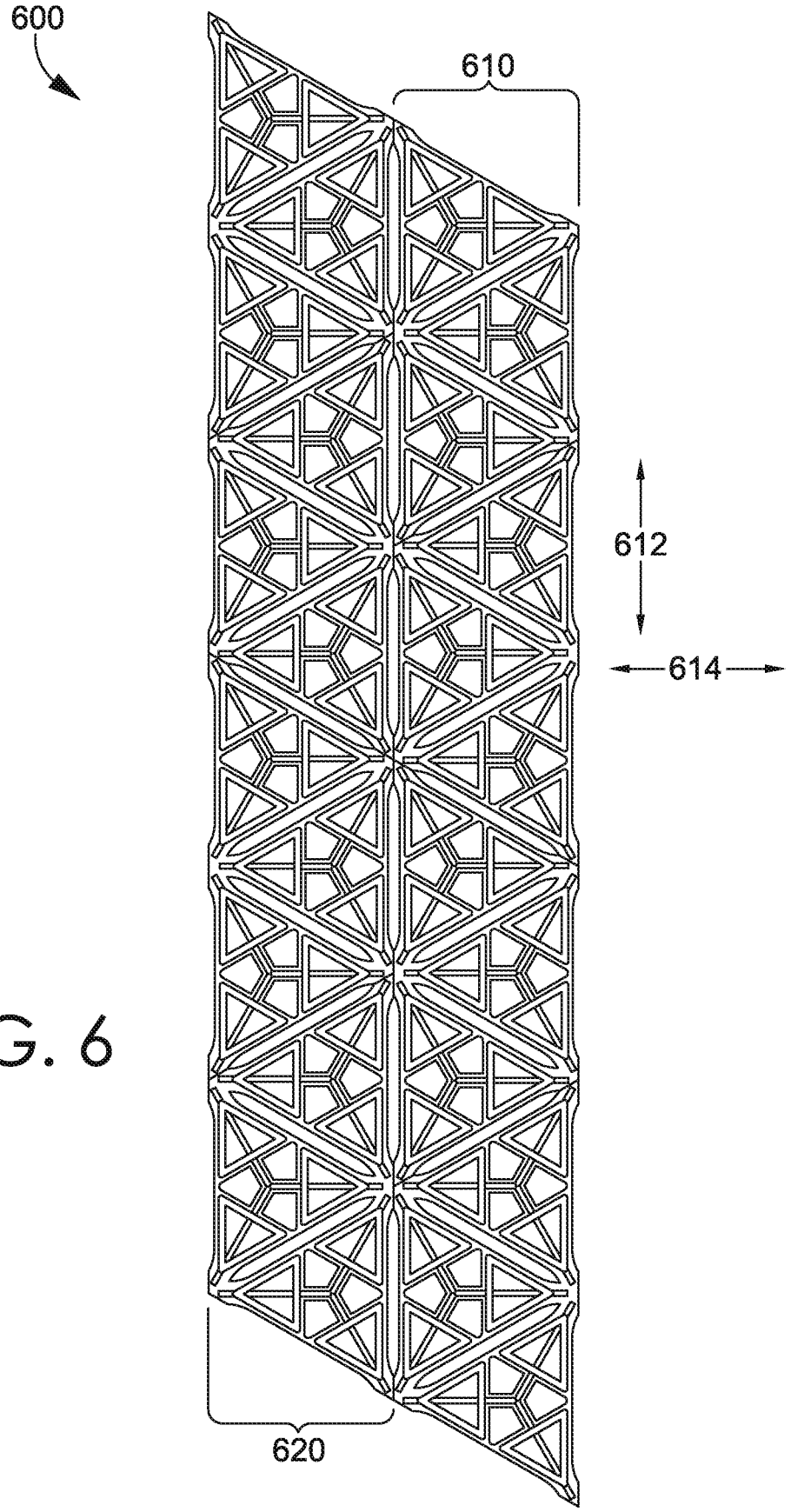
FIG. 6 illustrates a pair of components assembled in accordance with the present invention.

Referring now to FIG. 6, a protective structure 600 is illustrated. Protective structure 600 has been formed from a first strip 610 and a second strip 620. First strip 610 may comprise a first component having a first axis 612 extending along component 610 and a second axis 614 extending perpendicular to first axis 612. Similarly, second component 620 may extend along an axis parallel to first axis and another axis parallel to second axis 614. First component 610 and second component 620 may comprise a quadrilateral, such as shown in FIG. 6 or may comprise other configurations, some of which are described herein in examples.

In all of the examples illustrated herein, a first component having a repetitive pattern of varying thickness along a first axis and another repetitive pattern of varying thickness along a second axis may be provided adjacent to a second component. The second component that is adjacent to the first component may similarly have a varying thickness along an axis parallel to the first axis and another repetitive varying thickness along an axis parallel to the second axis. The precise configuration, orientation, size, and shape of the various components assembled in this manner may vary. Further, as described above, the method for retaining components in a desired as-worn position may vary in accordance with the present invention. Any type of material providing sufficient flexibility for an athlete may be utilized to provide impact protection in accordance with the present invention. Various elastomers, rubbers, nylons, and other polymers may be utilized in accordance with the present invention. Components useful in accordance with the present invention may be formed using processes such as injection molding, additive manufacturing, etc.

What is claimed is:

1. A modular impact absorption system comprising:

a first component and a second component, the first component and the second component each comprising:

a first surface opposite a second surface and a thickness extending between the first surface and the second surface;

a plurality of first walls coupled to the first surface and extending distally away from the first surface;

a plurality of second walls coupled to the first surface and extending distally away from the first surface; and a perimeter edge that forms three or more side edges around the plurality of first walls and the plurality of second walls, each side edge including a first nodal end, a second nodal end, and a recessed portion extending between the first nodal end and the second nodal end, wherein the first component includes a first-component side edge and the second component includes a second-component side edge, and wherein the first nodal end and the second nodal end of the first-component side edge are coupled with the first nodal end and the second nodal end of the second-component side edge, respectively, such that a slot is formed between the first component and the second component at the respective recessed portions;

each wall of the plurality of first walls including a first distal edge and a first wall height measured from the second surface to the first distal edge; and each wall of the plurality of second walls including a second distal edge and a second wall height measured from the second surface to the second distal edge, wherein the first wall height is taller than the second wall height;

wherein the first wall height is constant and wherein the second wall height is variable along a length of each wall of the plurality of second walls; and one or more apertures formed in each of the first component and the second component, each of the one or more apertures extending from a first opening associated with the first surface to a second opening associated with the second surface.

2. The modular impact absorption system of claim 1, wherein the first component and the second component each comprise triangular-shaped components.

3. The modular impact absorption system of claim 1, wherein the first component and second component are each coupled to at least one additional component at a common nodal point.

4. The modular impact absorption system of claim 3, wherein each of the first component, the second component and the at least one additional component are positioned radially around the common nodal point.

5. The modular impact absorption system of claim 1, wherein each of the first and second components has at least three wall-bound portions and an interstitial space between the at least three wall-bound portions, and wherein the one or more apertures are formed in the interstitial space.

* * * * *